US012302999B2

(12) United States Patent
Bugdaycay

(10) Patent No.: US 12,302,999 B2
(45) Date of Patent: May 20, 2025

(54) JEWELRY LINK

(71) Applicant: Cemayla, LLC, New York, NY (US)

(72) Inventor: Elizabeth A. Bugdaycay, New York, NY (US)

(73) Assignee: Cemayla, LLC, New York, NY (US)

( * ) Notice: Subject to any disclaimer, the term of this patent is extended or adjusted under 35 U.S.C. 154(b) by 0 days.

(21) Appl. No.: 18/580,014

(22) PCT Filed: Jul. 28, 2022

(86) PCT No.: PCT/US2022/038646
§ 371 (c)(1),
(2) Date: Jan. 17, 2024

(87) PCT Pub. No.: WO2023/009704
PCT Pub. Date: Feb. 2, 2023

(65) Prior Publication Data

US 2024/0324736 A1 Oct. 3, 2024

Related U.S. Application Data

(60) Provisional application No. 63/227,618, filed on Jul. 30, 2021.

(51) Int. Cl.
*A44C 5/10* (2006.01)
*A44C 11/00* (2006.01)

(52) U.S. Cl.
CPC ..... *A44C 5/10* (2013.01); *A44C 11/00* (2013.01)

(58) Field of Classification Search
CPC . F16G 15/00; F16G 15/12; A44C 5/10; A44C 11/00
USPC ..... D11/13; 59/80, 82, 84, 90, 91
See application file for complete search history.

(56) References Cited

U.S. PATENT DOCUMENTS

| | | | | |
|---|---|---|---|---|
| 758,802 | A * | 5/1904 | Ryan | A44C 11/00 59/90 |
| 1,168,328 | A * | 1/1916 | Williams | F16G 13/14 59/90 |
| 1,198,060 | A * | 9/1916 | Kollmar | A44C 11/00 59/83 |
| 1,610,690 | A * | 12/1926 | Kollmar | A44C 11/00 59/80 |
| 3,603,078 | A | 9/1971 | Schwiebert et al. | |
| 6,895,738 | B2 * | 5/2005 | Vito | F16G 13/00 59/93 |
| D703,577 | S | 4/2014 | Cipolla | |
| 8,756,907 | B2 | 6/2014 | Briscoe et al. | |
| 2004/0261394 | A1 | 12/2004 | Chia et al. | |
| 2008/0245049 | A1 | 10/2008 | Pengg | |

FOREIGN PATENT DOCUMENTS

EP 0 158 143 B1 10/1985

* cited by examiner

*Primary Examiner* — Jack W Lavinder
(74) *Attorney, Agent, or Firm* — COZEN O'CONNOR

(57) ABSTRACT

A jewelry link having a first portion having an end, legs extending from the end and terminating in first portion end faces, and a first cross section; and a second portion having an end, legs extending from the end and terminating in second portion end faces, and a second cross section. An outer circumferential portion of the legs of the first portion are attached to an outer circumferential portion of the legs of the second portion. The first portion end faces and the second portion end faces are visible.

11 Claims, 6 Drawing Sheets

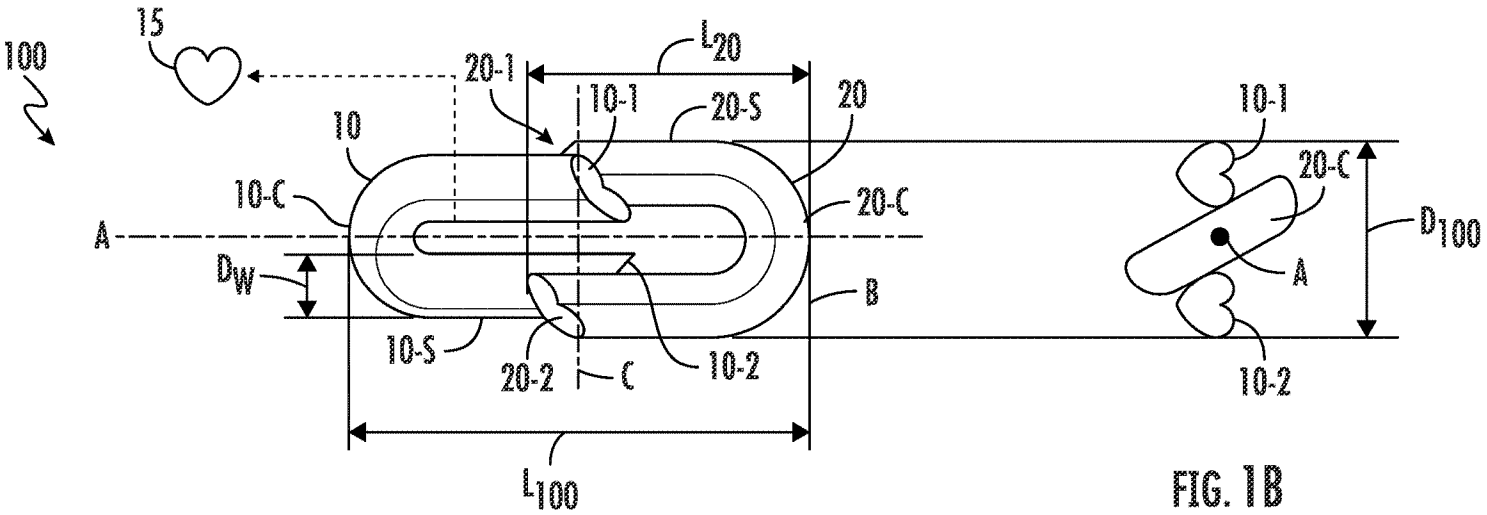
FIG. 1A
FIG. 1B
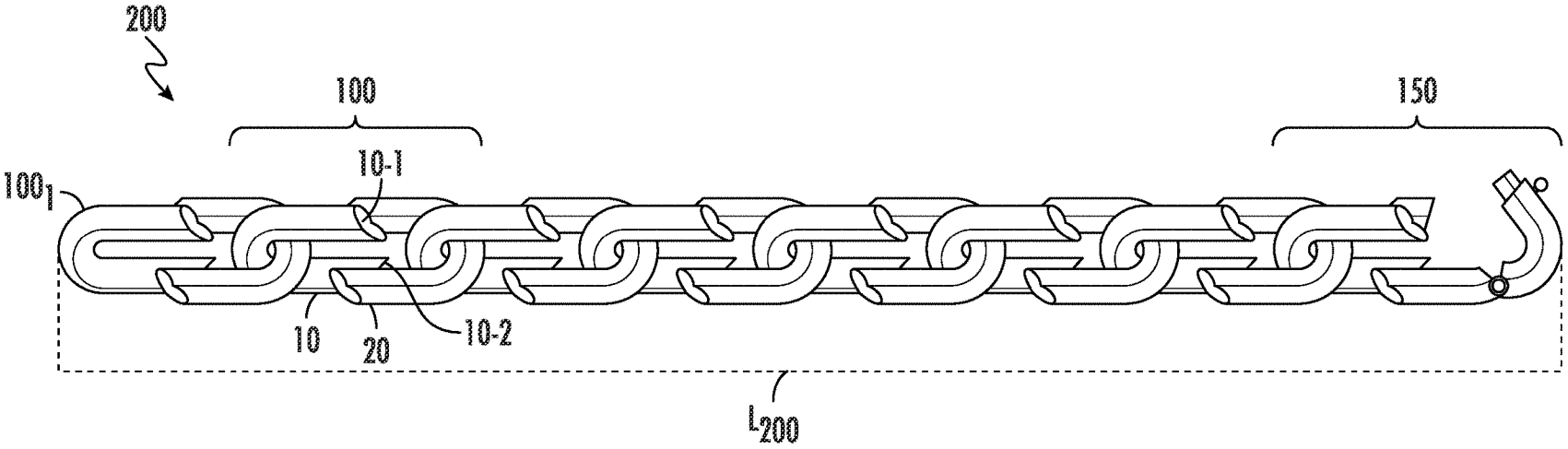
FIG. 2

JEWELRY LINK

PRIORITY CLAIM

This is a U.S. national stage of application No. PCT/US2022/038646, filed on Jul. 28 2022. Priority is claimed on U.S. Application No. 63/227,618, filed Jul. 30, 2021, the content of which is incorporated herein by reference.

FIELD OF THE INVENTION

The present disclosure is directed to the field of jewelry and specifically to links providing visual enhancement while also connecting to like members, or to other links, and/or connectors, for articles of jewelry such as chains, bracelets, necklaces, and earrings.

DESCRIPTION OF RELATED ART

Various types of links for jewelry are known and may serve a dual function of providing connection to an article of jewelry and/or connection to like members to provide a desired length suitable for a wearer, such as a chain necklace or bracelet. Links also enhance an overall appearance of the jewelry article. Typical links for chains may include cable links, oval links, round links, flat links, flat round links, twisted gourmet links, figure eight (infinity) links, square cube links, as well as others. Such links are typically closed loop in design and may be a carrier for a charm or gemstone.

SUMMARY OF THE INVENTION

Conventional links do not add multi-dimensional visual enhancement and/or exposed cross-sectional link faces such that when a jewelry article contains that link (or links), it is the link(s) themselves that specifically provide a focal point of interest to the wearer and/or the observer. Thus, there is a need for a visually enhanced jewelry link.

One aspect of the invention is a link comprising:

a first portion having an end, legs extending from the end and terminating in first portion end faces, and a first cross section; and a second portion having an end, legs extending from the end and terminating in second portion end faces, and a second cross section;

wherein an outer circumferential portion of the legs of the first portion are attached to an outer circumferential portion of the legs of the second portion;

wherein the first portion end faces and the second portion end faces are visible.

According to one aspect, the first portion and the second portion are arranged on a common longitudinal axis and the first portion and the second portion are rotated with respect to one another about the common longitudinal axis.

According to one aspect, the first portion and the second portion are each arranged on a respective longitudinal axis and the first portion and the second portion are arranged such that their respective longitudinal axes are offset with respect to one another.

According to one aspect, the first portion and the second portion each have a longitudinal axis and at least one end face is perpendicular to the longitudinal axis.

According to one aspect, the first portion and the second portion each have a longitudinal axis and at least one end face is arranged at an angle with respect to the longitudinal axis.

According to one aspect, the link is one of a polygon, a circle, and an oval.

According to one aspect, the first portion has a twist between the first portion end faces.

According to one aspect, the twist of the first portion between the first portion end faces is at least 180°.

According to one aspect, the first cross section is the same as the second cross section.

According to one aspect, the first cross section is different than the second cross section.

According to one aspect, one of the first portion and the second portion is configured as a clasp.

According to one aspect, a chain comprises:

at least one profiled link comprising:

a first portion having an end, legs extending from the end and terminating in first portion end faces, and a first cross section; and a second portion having an end, legs extending from the end and terminating in second portion end faces, and a second cross section;

wherein an outer circumferential portion of the legs of the first portion are attached to an outer circumferential portion of the legs of the second portion, wherein the first portion end faces and the second portion end faces are visible.

According to one aspect, the chain further comprises one or more connector links coupled to the at least one profiled link.

According to one aspect, the chain further comprises a clasp having a hinged portion configured to detachably coupled to at least one of the at least one profiled link and the one or more connector links.

BRIEF DESCRIPTION OF THE DRAWINGS

Preferred further developments of the invention are obtained from the claims and the following description. Exemplary embodiments of the invention are explained in more detail by way of the drawings. Embodiments of such a link arrangement in connection with embodiments of the invention are shown with reference to the drawings where:

FIG. 1A is a perspective view of a link;

FIG. 1B is an end view of the link of FIG. 1A;

FIG. 2 is a perspective view of a chain that includes a plurality of the links as shown in FIG. 1A;

DETAILED DESCRIPTION OF THE EMBODIMENTS

Figure 3A:
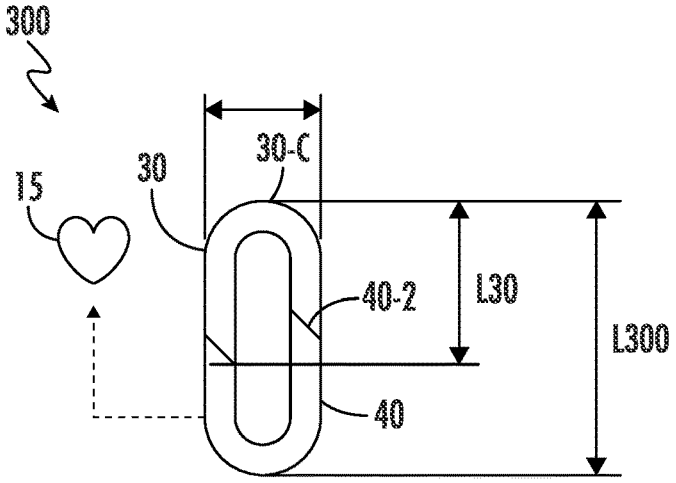
FIG. 3A is a perspective view of a link.

FIG. 1A illustrates a perspective view of a link 100 having first portion 10 and second portion 20 fixedly attached to each other. Each of the first and second portions 10, 20 includes exposed first and second cross-sectional faces. As shown, the exposed cross-sectional faces are angled and are heart-shaped 15.

A link 100 for a chain 200, as shown for example in in FIG. 2, for a jewelry article is shown. Link 100 includes a first portion 10 and a second portion 20. Portions 10 and 20 are positioned about longitudinal axis A, rotated with respect to each other. Portions 10 and 20 may be derived from a single member that has been cut, e.g., sawed perpendicularly or at an angle, as shown. Alternatively, each portion 10, 20 may be extruded and bent, cast, molded, or otherwise formed as individual portions or the finished link can be cast or molded so that no assembly of the two portions is required. The first and second portions 10, 20 can be manufactured using any known jewelry techniques and fashioned out of metal, precious metal, semi-precious metal, plastic, or any suitable substances.

Link 100 has a length, L100, as shown from curved portion 10-C of portion 10 to curved portion 20-C of portion 20. Line C, transverse to longitudinal axis A, intersects at the midpoint of L100. The portions 10 and 20 overlap and the length L100 can be adjusted by varying the overlap. According to one aspect of the invention, at least part of an end face of each portion 10 and 20 is arranged on line C. Each portion 10, 20 can have a same overall length or each can be a different length.

As shown in FIG. 1A, each portion 10 and 20 includes first and second exposed cross-sectional faces 10-1, 10-2, 20-1, and 20-2. In a top view of link 100, Shown in FIG. 1B, the exposed cross-sectional faces 10-1 and 10-2 are visible along with the curved portion 20-C of portion 20. Exposed cross-sectional faces 10-1 and 20-2 can be perpendicular or at an angle with respect to axis A. Exposed cross-sectional faces 10-1 and 10-2 extend away from curved portion 10-C and at least partially cross line C forming a substantially U-shaped portion. Likewise, exposed cross-sectional faces 20-1 and 20-2 extend away from curved portion 20-C and at least partially cross line C forming a substantially U-shaped portion. While each leg is shown having a same length, the legs can have different lengths.

The exposed cross-sectional faces 10-1, 20-2 may be angled as shown, or alternatively, cut perpendicularly relative to sides 10-S and/or 20-S. Importantly, the exposed cross-sectional faces include a cross-sectional shape 15. For illustrative purposes, cross-sectional shape 15 is heart-shaped, however, any other extruded or formable cross-sectional shape is suitable. Formable shapes contemplated, but not limited to, include heart-shaped, cross-shaped, star-shaped, clover-shaped, flower-shaped, moon-shaped, half-moon-shaped, diamond-shaped, club-shaped, spade-shaped, triangular, rectangular, oval, round, polygonal, letter-shaped, number-shaped, as well as others. Preferably, the shapes are extrudeable.

Portion 10 includes external side surface 10-S and portion 20 includes external side surface 20-S. As described above, portions 10 and 20 are positioned about longitudinal axis A, rotated with respect to each other. In other words, first portion 10 may be positioned rotatably about axis A in a direction opposite that of portion 20 to an angle of up to 180°. The first and second portions are fixedly attached, e.g., soldered, welded, glued, or the like, at any point along a circumference of external side surface 10-S to external side surface 20-S so that all four cross-section ends 10-1, 10-2, 20-1, and 20-2 are exposed.

FIG. 2 illustrates a perspective view of chain 200, such as for a necklace or a bracelet or other jewelry article, that includes a plurality of the links 100 as shown in FIG. 1. Each link 100 is consecutively interconnected with the next like element to form a chain of any desired length. For each link 100, four exposed cross-sectional faces 10-1, 10-2, 20-1, and 20-2 are visible to the wearer and/or the observer. Chain 200 may include a clasping link 150 having a mechanism for interconnecting to the first link 1001 to form a closed loop of the chain 200. The components of clasping link 150 are configured to engage with and connect to each other to provide a securing mechanism to secure the jewelry article to a wearer. The clasping link 150 is spring loaded and hinged and has a cross sectional shape that matches the link 100.

Figure 3B:
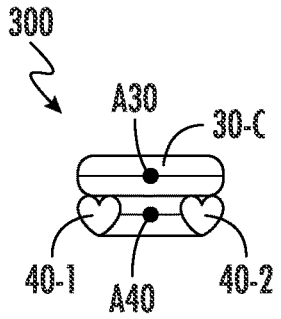
FIG. 3B is a top view of a link of FIG. 3A.
Figure 3C:
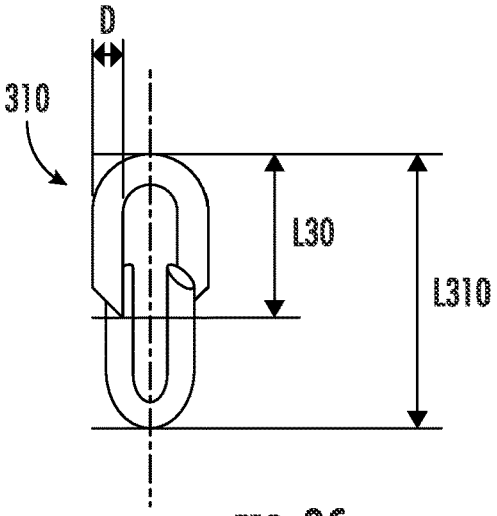
FIG. 3C is a side perspective view of a link.
Figure 3D:
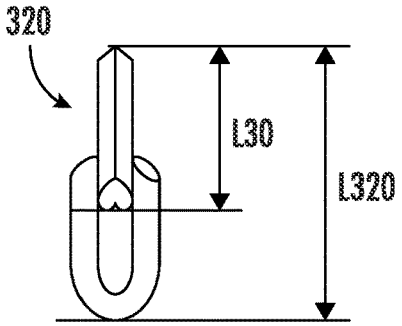
FIG. 3D is a side view of a link.

FIGS. 3A, 3C, and 3D illustrate a perspective views of different link having first and second portions orientated with respect to one another about longitudinal axis A differently, as compared with the link 100 of FIG. 1. Each of the first and second portions includes exposed first and second cross-sectional faces that include a shape.

FIG. 3A shows an alternate embodiment for a link 300 having a different orientation as compared with link 100, as illustrated in a side view looking toward the link 300. The link portion 30 has a length L30 and the link 300 has a length L300. If the length of the link portion 40 is the same as the link portion 30, the overlap between the link portions 30, can be found by the following equation overlap=2*L30−L300. As shown, link 300 includes two U-shaped portions 30 and 40, which are again positioned about longitudinal axis A rotated with respect to each other. In the particular position shown in FIG. 3A the links are stacked on top of each other. In other words, a part of the outer circumference of each leg of portion 30 is in contact with a corresponding part of the outer circumference of each leg of portion 40. Each leg contacts and is attached to a corresponding radial position on a circumference of the other leg. The longitudinal axis A of each U-shaped portion 30, 40 are offset from each other. The offset corresponds to the cross sectional width. Similarly, as for link 100 of FIG. 1, link 300 includes four exposed cross-sectional faces that are visible to the wearer and/or the observer for each link 300.

FIG. 3B shows link 300 in top view looking toward the curved portion 30-C and viewing the exposed cross-sectional faces 40-1, 40-2 of portion 40. A part of the outer circumference of each leg of portion 30 is in contact with a part of the outer circumference of each leg of portion 40. The longitudinal axis A30 of U-shaped portion 30 is offset from longitudinal axis A40 of U-shaped portion 40.

FIG. 3C shows an alternate embodiment for a link 310 having a different orientation as compared with link 100, as illustrated in a side view looking toward the link 310. As shown, link 310 includes two U-shaped portions 30 and 40, which are again positioned about longitudinal axis A rotated with respect to each other. In FIG. 3C first portion 30 is positioned rotated about axis A in a direction opposite that of portion 40 at an angle. The link portion 30 has a diameter D and a length L30. The link 310 has a length L310. If the length of the link portion 40 is the same as the link portion 30, the overlap between the link portions 30, can be found by the following equation overlap=2*L30−L310. Similarly, as for link 100 of FIG. 1, link 310 includes four exposed cross-sectional faces that are visible to the wearer and/or the observer for each link 310.

FIG. 3D shows an alternate embodiment for a link 320 having a different orientation as compared with link 100, as illustrated in a side view looking toward the link 320. As shown, link 320 includes two U-shaped portions 30 and 40, which are again positioned about longitudinal axis A rotated with respect to each other. In FIG. 3C first portion 30 is positioned rotated about axis A in a direction opposite that of portion 40 at an angle of about 90°. The link portion 30 has a length L30 and the link 320 has a length L320. If the length of the link portion 40 is the same as the link portion 30, the overlap between the link portions 30, can be found by the following equation overlap=2*L30−L320. Similarly, as for link 100 of FIG. 1, link 320 includes four exposed cross-sectional faces that are visible to the wearer and/or the observer for each link 300.

Figure 3E:
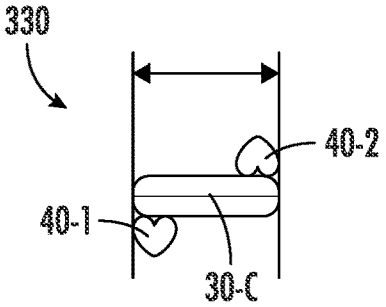
FIG. 3E is a top view of a link.

FIG. 3E shows an alternate embodiment for a link 330 having a different orientation as compared with link 100, as illustrated in top view looking toward the curved portion 30-C and viewing the exposed cross-sectional faces 40-1, 40-2 of portion 40. Part of the outer circumference of each leg of portion 30 is in contact with part of the outer circumference of each leg of portion 40. Each link portion 30, 40 can also be twisted. For example, the ends of link 40 are twisted by about 180°. Other values for twist can be used, including multiple twists.

Figure 4:
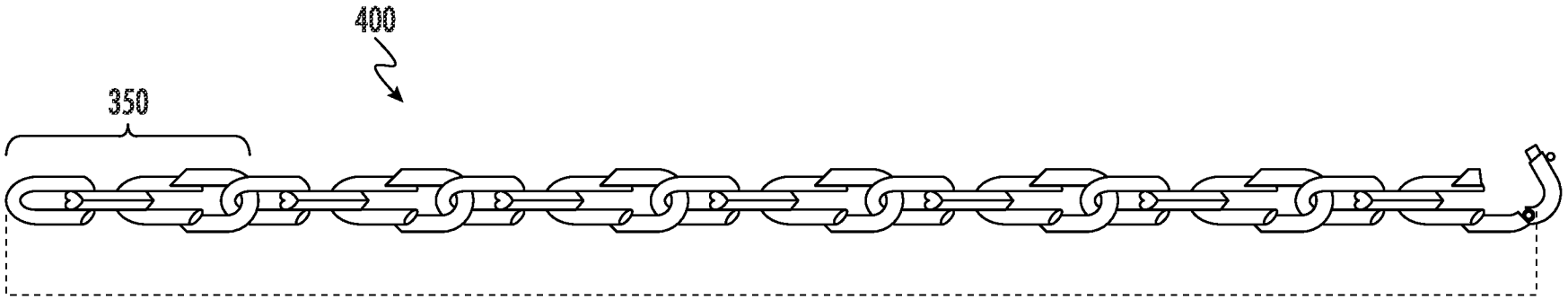
FIG. 4 is a perspective view of a chain that includes a plurality of the links of FIG. 3A.

FIG. 4 illustrates a perspective view of a chain 400, such as for a necklace or a bracelet, that includes a plurality of links. Chain 400 may include repeating units of two links 350, where the pair of links may include the same or different orientation, where the orientation is the angle at which the two portions are oriented with respect to one another about the longitudinal axis A.

Figure 5:
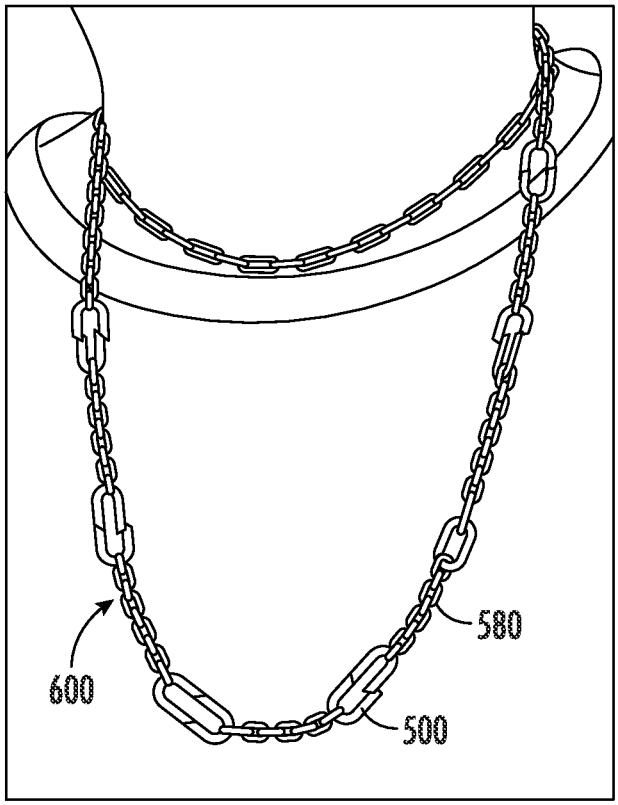
FIG. 5 is a perspective view of a necklace including a plurality of links according to FIG. 1A, where the links are attached alternatingly with other links and/or connectors.
Figure 6:
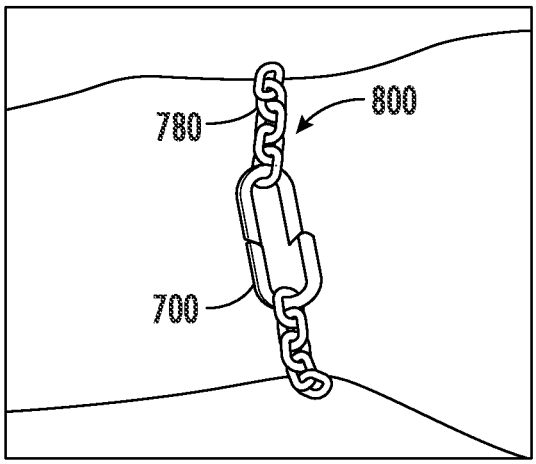
FIG. 6 is a perspective view of a bracelet.
Figure 7A:
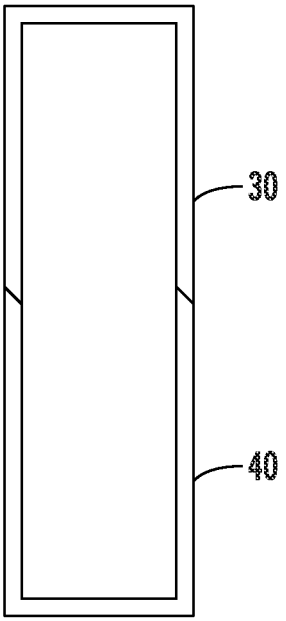
FIGS. 7A-7D are side views of different links.
Figure 7B:
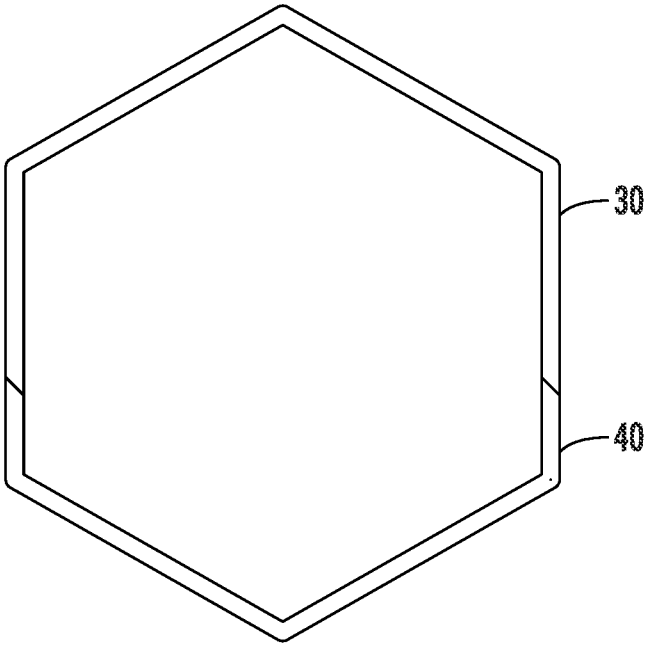
Figure 7C:
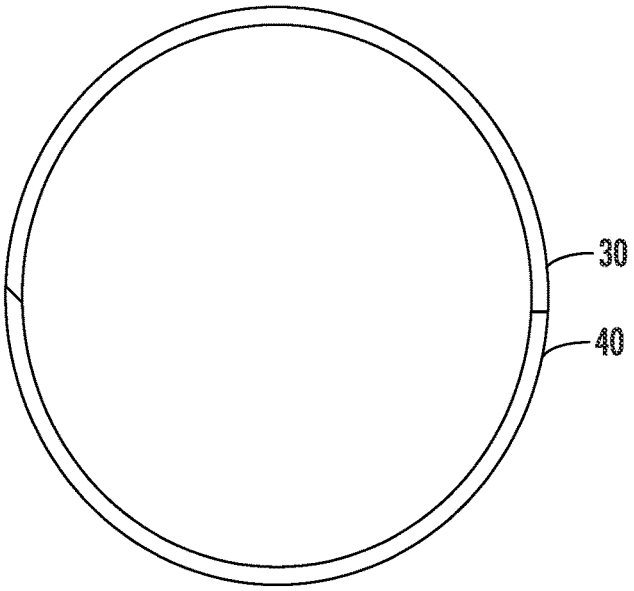
Figure 7D:
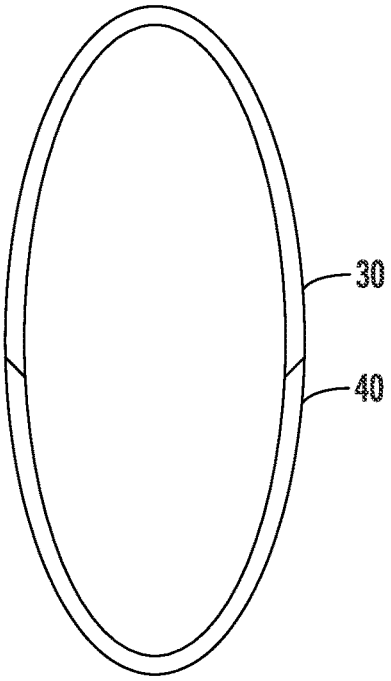

Chains 200 and 400 as shown include consecutively repeating units of like elements, e.g., links 100 and/or link pairs 350. Jewelry articles as contemplated herein may further include other chain elements such as other links and/or connectors. As shown in FIGS. 5 and 6, the links as described herein may be included separated by other links and/or connectors. FIG. 5 shows necklace 600 having links 500 separated by one or more other links and/or connectors 580. Links 500 include exposed cross-sectional faces that are angled and are heart-shaped. FIG. 6 shows bracelet 800 including other links and/or connectors 780 and featuring a singular link 700, such as those described herein and having four exposed cross-sectional faces having a shape. Link 700 provides visual enhancement for jewelry article, bracelet 800.

While shown as U-shaped, portions 30, 40 can be polygonal such as part of a rectangle, part of a hexagon, part of a circle, part of an oval, part of an octagon, or the like as shown in FIGS. 7A-7D.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A link comprising:

a first portion having an end, legs extending from the end and terminating in first portion end faces, and a first cross section; and a second portion having an end, legs extending from the end and terminating in second portion end faces, and a second cross section;

wherein an outer circumferential portion of the legs of the first portion are attached to an outer circumferential portion of the legs of the second portion, wherein the first portion end faces and the second portion end faces are visible; and wherein the first portion and the second portion are each arranged on a respective longitudinal axis and the first portion and the second portion are arranged such that their respective longitudinal axes are offset with respect to one another.

2. The link of claim 1, wherein the first portion and the second portion each have a longitudinal axis and at least one of each of the first and second end faces are perpendicular to the longitudinal axis.

3. The link of claim 1, wherein the first portion and the second portion each have a longitudinal axis and at least one of the first or second end faces is arranged at an angle with respect to the longitudinal axis.

4. The link of claim 1, wherein the link is one of a polygon, a circle, and an oval.

5. The link of claim 1, wherein the first portion has a twist between the first portion end faces.

6. The link of claim 5, wherein the twist of the first portion between the first portion end faces is at least 180°.

7. The link of claim 1, wherein the first cross section is a same as the second cross section.

8. The link of claim 1, wherein one of the first portion and the second portion is configured as a clasp having a hinged portion.

9. A link comprising:

a first portion having an end, legs extending from the end and terminating in first portion end faces, and a first cross section; and a second portion having an end, legs extending from the end and terminating in second portion end faces, and a second cross section;

wherein an outer circumferential portion of the legs of the first portion are attached to an outer circumferential portion of the legs of the second portion, and wherein the first portion end faces and the second portion end faces are visible, and the first portion has a twist between the first portion end faces.

10. The link of claim 9, wherein the first portion has a twist between the first portion end faces.

11. A link comprising:

a first portion having an end, legs extending from the end and terminating in first portion end faces, and a first cross section; and a second portion having an end, legs extending from the end and terminating in second portion end faces, and a second cross section;

wherein an outer circumferential portion of the legs of the first portion are attached to an outer circumferential portion of the legs of the second portion, the first portion end faces and the second portion end faces are visible; and wherein one of the first portion and the second portion is configured as a clasp having a hinged portion.

* * * * *